US007648950B2

(12) United States Patent
Placek et al.

(10) Patent No.: US 7,648,950 B2
(45) Date of Patent: Jan. 19, 2010

(54) USE OF A POLYALKYLMETHACRYLATE POLYMER

(75) Inventors: Douglas G. Placek, Yardley, PA (US); Christian D. Neveu, Santeny (FR); Roland Schweder, Darmstadt (DE); Robert P. Simko, Norristown, PA (US); Charles W. Hyndman, Hartfield, PA (US)

(73) Assignee: Rohmax Additives GmbH, Darmstadt (DE)

( * ) Notice: Subject to any disclaimer, the term of this patent is extended or adjusted under 35 U.S.C. 154(b) by 614 days.

(21) Appl. No.: 11/111,887

(22) Filed: Apr. 22, 2005

(65) Prior Publication Data

US 2006/0240999 A1 Oct. 26, 2006

(51) Int. Cl.
*C10L 10/18* (2006.01)
*C10M 145/14* (2006.01)

(52) U.S. Cl. ..... 508/466; 508/469

(58) Field of Classification Search ..... 508/466
See application file for complete search history.

(56) References Cited

U.S. PATENT DOCUMENTS 3,340,193 A * 9/1967 Fields et al. ..... 508/469
4,101,431 A * 7/1978 Kuntschik ..... 508/282
2005/0148749 A1 7/2005 Scherer et al.
2005/0245406 A1* 11/2005 Scherer et al. ..... 508/469
2006/0240999 A1 10/2006 Placek
2007/0197410 A1 8/2007 Placek et al.
2007/0219101 A1 9/2007 Scherer et al.
2008/0302422 A1 12/2008 Neveu et al.

OTHER PUBLICATIONS

U.S. Appl. No. 10/592,363, filed Sep. 11, 2006, Scherer, et al.
U.S. Appl. No. 10/593,082, filed Sep. 15, 2006, Scherer, et al.
U.S. Appl. No. 11/547,612, filed Oct. 4, 2006, Scherer, et al.
U.S. Appl. No. 11/572,181, filed Jan. 16, 2007, Scherer, et al.
U.S. Appl. No. 11/572,330, filed Jan. 19, 2007, Acker, et al.
U.S. Appl. No. 11/111,887, filed Apr. 22, 2005, US2006/0240999 A1, Placek et al., Oct. 2006.
U.S. Appl. No. 61/105,065, filed Oct. 14, 2008, Placek et al.
U.S. Appl. No. 11/357,195, filed Feb. 21, 2006, US2007/0197410 A1, Placek et al., Aug. 2007.
U.S. Appl. No. 11/759,690, filed Jun. 7, 2007, US2008/0302422 A1, Neveu et al., Dec. 2008.
U.S. Appl. No. 11/547,612, filed oct. 4, 2006, US2007/0219101 A1, Scherer et al., Sep. 2007.
U.S. Appl. No. 12/347,608, filed Dec. 31, 2008, Michael et al.
U.S. Appl. No. 61/186,744, filed Jun. 12, 2009, Radano et al.

* cited by examiner

*Primary Examiner*—Walter D Griffin
*Assistant Examiner*—Frank C Campanell
(74) *Attorney, Agent, or Firm*—Oblon, Spivak, McClelland, Maier & Neustadt, L.L.P.

(57) ABSTRACT

The present invention relates to the use of a polyalkylmethacrylate polymer to improve the air release of a functional fluid.

33 Claims, 2 Drawing Sheets

D 3427 – 02

USE OF A POLYALKYLMETHACRYLATE POLYMER

Figure 1:
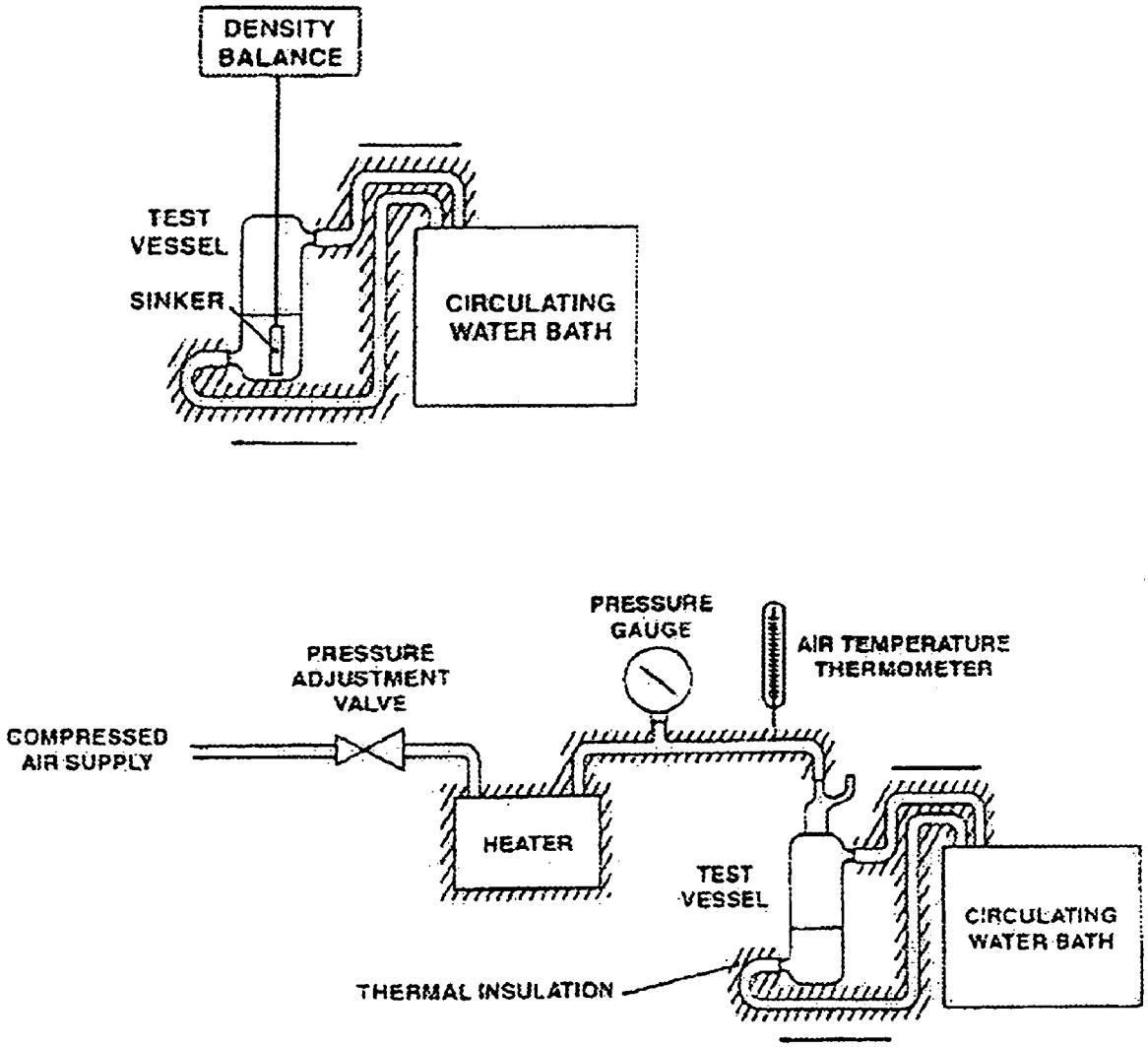

The present invention is directed to a use of a polyalkylmethacrylate polymer.

Lubricants must provide sufficient viscosity at normal operating temperatures to reduce the friction and wear of moving parts. If lubricating films are too thin due to low viscosity, then parts are not adequately protected and may suffer reduced operating life. Extremely low viscosity at maximum operating temperatures can lead to high rates of wear or equipment failure due to seizure/welding. Hydraulic fluids must provide sufficient viscosity at operating temperatures in order to minimize internal pump recycle or leakage. If hydraulic fluid viscosity drops to an undesirable level, pump efficiency will drop to an unacceptable level. Poor pump efficiency leads to energy consumption level that are higher than necessary.

In many applications the maximum fluid viscosity is limited by the air release properties of the fluid or lubricant. As the fluid moves through the system, it will typically entrain a certain amount of air due to agitation, splashing, or pressure drop. Systems are typically designed with an oil sump in the circulation path that allows the fluid to sit for a period of time to release entrained air and/or heat. A standard design rule is to size a hydraulic fluid reservoir at 2.5 times the pump flowrate. (Kokernak, R. P., Fluid Power Technology, 1999). It is desirable to size the reservoir as large as possible, however this is not practical in many applications (mobile equipment or confined spaces), and also increases the volume of fluid required and overall costs. A fluid with improved air release properties can enable a system designer to reduce costs and/or improve performance by using a smaller reservoir and oil charge. Fast release of entrained air is important for hydraulic and metalworking fluids, as well as lubricants used in engines, transmissions, turbines, compressors, gear boxes, and roller bearings.

It is well known that air bubbles will release quickly from thin fluids (water or light viscosity grade oils), and more slowly from thick fluids (gels or high viscosity grade oils). Viscosity grades are typically used to describe the various categories of fluid viscosity, and are summarized in Table 1.

TABLE 1

Viscosity limits of ISO VG categories described by ISO 3448

| ISO 3448 Viscosity Grades | Typical Viscosity, cSt @ 40° C. | Minimum Viscosity, cSt @ 40° C. | Maximum Viscosity, cSt @ 40° C. |
|---|---|---|---|
| ISO VG 15 | 15.0 | 13.5 | 16.5 |
| ISO VG 22 | 22.0 | 19.8 | 24.2 |
| ISO VG 32 | 32.0 | 28.8 | 35.2 |
| ISO VG 46 | 46.0 | 41.4 | 50.6 |
| ISO VG 68 | 68.0 | 61.2 | 74.8 |
| ISO VG 100 | 100.0 | 90.0 | 110.0 |
| ISO VG 150 | 150.0 | 135.0 | 165.0 |

A variety of hydraulic fluid specifications established by equipment builders and regional work groups are summarized in Table 2. It can bee seen that less viscous oils will release air faster than higher viscosity oils.

TABLE 2

Global and Regional Air Release Specifications (air release time in minutes measured by ASTM D 3427 or DIN 51 381 test methods)

| | ISO VG 15 | ISO VG 22 | ISO VG 32 | ISO VG 46 | ISO VG 68 | ISO VG 100 | ISO VG 150 |
|---|---|---|---|---|---|---|---|
| ASTM D 6158 | 5 | 5 | 5 | 10 | 13 | — | — |
| DIN 51524 | 5 | 5 | 5 | 10 | 10 | 14 | |
| Swedish Standard 14 54 34 | — | — | 8 | 10 | 10 | — | — |
| ISO 11158 | 5 | 5 | 5 | 10 | 13 | 21 | 32 |
| AFNOR NF E 48-603 | 5 | 5 | 5 | 7 | 10 | — | — |

Air release performance is typically measured by ASTM D3427 or DIN 51 381 test methods. In this test procedure, 180 ml of fluid is stabilized at 50° C. and the original density is measured. An air-in-oil dispersion is created by introducing a stream of compressed air through a capillary tube for 7 minutes. The time required for the fluid to return to within 0.2% of its original density is measured and recorded as the air release time.

If the air content of a fluid or lubricant is too high, the fluid may form incomplete oil films in contact zones, or become incapable of maintaining system pressure. High levels of entrained air will also result in cavitation, erosion, and high noise levels. Compression of air bubbles in a liquid can lead to ignition of the vapor inside the bubble, known as the micro-diesel effect. These micro explosions lead to accelerated fluid degradation (temperatures of over 1000° C. are reached) and structural damage of metal parts.

It is also well known that certain fluid and lubricant additives can have a negative effect on air release performance. Certain additives used to control foaming tendency have been shown to inhibit air release time. Document U.S. Pat. No. 5,766,513 discloses a combination of a fluorosilicone antifoamant and a polyacrylate antifoamant being effective in reducing foaming without degrading the air release. However, an improvement in air release cannot be achieved by using the combination according to U.S. Pat. No. 5,766,513.

While most fluid or lubricant additives do not have any significant negative effect on air release properties, there are no additives that are known to improve air release performance. As fluids degrade in service due to oxidation or contamination (water, dirt, wear debris, metal fines, combustion residue), air release properties are also known to deteriorate. The only known method for improving air release performance of a new fluid is to reduce viscosity. Used fluids can be restored to their original state with filtration or dehydration techniques.

Taking into consideration the prior art, it is an object of this invention to make available functional fluids having an improved air release at a desired viscosity grade. In addition, it is an object of the present invention to provide functional fluids that have good low temperature properties. Furthermore, it should be possible to produce the fluids in a simple and cost effective manner. Additionally, it is an object of the present invention to supply functional fluids being applicable over a wide temperature range. Furthermore, the fluid should be appropriate for high pressure applications.

These as well as other not explicitly mentioned tasks, which, however, can easily be derived or developed from the introductory part, are solved by the use of a polyalkylmethacrylate polymer to improve the air release of a functional fluid. Expedient modifications of the fluids in accordance with the invention are described in the claims.

The use of polyalkylmethacrylate polymer to improve the air release of a functional fluid provides a functional fluid at the same desired viscosity grade with improved air release speed.

At the same time a number of other advantages can be achieved through the functional fluids in accordance with the invention. Among these are:

The functional fluid of the present invention shows an improved low temperature performance and broader temperature operating window.

The functional fluid of the present invention can be produced on a cost favorable basis.

The functional fluid of the present invention exhibits good resistance to oxidation and is chemically very stable.

The viscosity of the functional fluid of the present invention can be adjusted over a broad range.

Furthermore, the fluids of the present invention are appropriate for high pressure applications. The functional fluids of the present invention show a minimal change in viscosity due to good shear stability.

The fluid of the present invention comprises polyalkylmethacrylate polymer. These polymers obtainable by polymerizing compositions comprising alkylmethacrylate monomers are well known in the art. Preferably, these polyalkylmethacrylate polymers comprise at least 40% by weight, especially at least 50% by weight, more preferably at least 60% by weight and most preferably at least 80% by weight methacrylate repeating units. Preferably, these polyalkylmetlacrylate polymers comprise $C_9$-$C_{24}$ methacrylate repeating units and $C_1$-$C_8$ methacrylate repeating units Preferably, the compositions from which the polyalkylmethacrylate polymers are obtainable contain, in particular, (meth)acrylates, maleates and fumarates that have different alcohol residues. The term (meth)acrylates includes methacrylates and acrylates as well as mixtures of the two. These monomers are to a large extent known. The alkyl residue can be linear, cyclic or branched.

Mixtures to obtain preferred polyalkylmethacrylate polymers contain 0 to 100 wt %, preferably 0,5 to 90 wt %, especially 1 to 80 wt %, more preferably 1 to 30 wt %, more preferably 2 to 20 wt % based on the total weight of the monomer mixture of one or more ethylenically unsaturated ester compounds of formula (1)

(I)

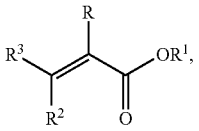

where R is hydrogen or methyl, $R^1$ means a linear or branched alkyl residue with 1-8 carbon atoms, $R^2$ and $R^3$ independently represent hydrogen or a group of the formula —COOR', where R' means hydrogen or a alkyl group with 1-8 carbon atoms.

Examples of component (a) are, among others, (meth) acrylates, fumarates and maleates, which derived from saturated alcohols such as methyl (meth)acrylate, ethyl (meth) acrylate, n-propyl (meth)acrylate, isopropyl (meth)acrylate, n-butyl (meth)acrylate, tert-butyl (meth)acrylate, pentyl (meth)acrylate and hexyl (meth)acrylate, 2-ethylhexyl (meth)acrylate, heptyl (meth)acrylate, octyl (meth)acrylate; cycloalkyl (meth)acrylates, like cyclopentyl (meth)acrylate, 3-vinylcyclohexyl (meth)acrylate, cyclohexyl (meth)acrylate.

Furthermore, the monomer compositions to produce the polyalkylmethacrylates useful in the present invention contain 0-100, preferably 10-99 wt %, especially 20-95 wt % and more preferably 30 to 85 wt % based on the total weight of the monomer mixture of one or more ethylenically unsaturated ester compounds of formula (II)

(II)

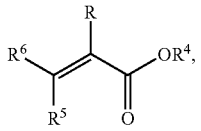

where R is hydrogen or methyl, $R^4$ means a linear or branched alkyl residue with 9-16 carbon atoms, $R^5$ and $R^6$ independently are hydrogen or a group of the formula —COOR", where R" means hydrogen or an alkyl group with 9-16 carbon atoms.

Among these are (meth)acrylates, fumarates and maleates that derive from saturated alcohols, such as 2-tert-butylheptyl (meth)acrylate, 3-isopropylheptyl (meth)acrylate, nonyl (meth)acrylate, decyl (meth)acrylate, undecyl (meth)acrylate, 5-methylundecyl (meth)acrylate, dodecyl (meth)acrylate, 2-methyldodecyl (meth)acrylate, tridecyl (meth)acrylate, 5-methyltridecyl (meth)acrylate, tetradecyl (meth) acrylate, pentadecyl (meth)acrylate, hexadecyl (meth) acrylate;

cycloalkyl (meth)acrylates such as bornyl (meth)acrylate; and the corresponding fumarates and maleates.

Furthermore, the monomer compositions to produce the polyalkylmethacrylates useful in the present invention contain 0-80, preferably 0,5-60 wt %, especially 1-40 wt % and more preferably 2 to 30 wt % based on the total weight of the monomer mixture of one or more ethylenically unsaturated ester compounds of formula (III)

(III)

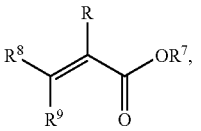

where R is hydrogen or methyl, $R^7$ means a linear or branched alkyl residue with 17-40 carbon atoms, $R^8$ and $R^9$ independently are hydrogen or a group of the formula —COOR'", where R'" means hydrogen or an alkyl group with 17-40 carbon atoms.

Among these are (meth)acrylates, fumarates and maleates that derive from saturated alcohols, such as 2-methylhexadecyl (meth)acrylate, heptadecyl (meth)acrylate, 5-isopropylheptadecyl (meth)acrylate, 4-tert-butyloctadecyl (meth)acrylate, 5-ethyloctadecyl (meth)acrylate, 3-isopropyloctadecyl (meth)acrylate, octadecyl (meth)acrylate, nonadecyl (meth) acrylate, eicosyl (meth)acrylate, cetyleicosyl (meth)acrylate, stearyleicosyl (meth)acrylate, docosyl (meth)acrylate, and/or eicosyltetratriacontyl (meth)acrylate; cycloalkyl (meth)acrylates such as 2,4,5-tri-t-butyl-3-vinylcyclohexyl (meth)acrylate, 2,3,4,5-tetra-t-butylcyclohexyl (meth)acrylate.

The ester compounds with a long-chain alcohol residue, especially components (b) and (c), can be obtained, for example, by reacting (meth)acrylates fumarates, maleates and/or the corresponding acids with long chain fatty alcohols, where in general a mixture of esters such as (meth)acrylates with different long chain alcohol residues results.

These fatty alcohols include, among others, Oxo Alcohol® 7911 and Oxo Alcohol® 7900, Oxo Alcohol® 1100; Alfol® 610 and Alfol® 810; Lial® 125 and Nafol®-Types (Sasol Olefins & Surfactant GmbH); Alphanol® 79 (ICI);Epal® 610 and Epal® 810 (Ethyl Corporation); Linevol® 79, Linevol® 911 and Neodol® 25E (Shell AG); Dehydad®-, Hydrenol- and Lorol®-Types (Cognis); Acropol® 35 and Exxal® 10 (Exxon Chemicals GmbH); Kalcol® 2465 (Kao Chemicals).

Of the ethylenically unsaturated ester compounds, the (meth)acrylates are particularly preferred over the maleates and furmarates, i.e., $R^2$, $R^3$, $R^5$, $R^6$, $R^8$ and $R^9$ of formulas (I) (II) and (III) represent hydrogen in particularly preferred embodiments.

Component (d) comprises in particular ethylenically unsaturated monomers that can copolymerize with the ethylenically unsaturated ester compounds of formula (I) (II) and/or (III).

Comonomers that correspond to the following formula are especially suitable for polymerization in accordance with the invention:

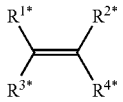

where $R^{1*}$ and $R^{2*}$ independently are selected from the group consisting of hydrogen, halogens, CN, linear or branched alkyl groups with 1-20, preferably 1-6 and especially preferably 1-4 carbon atoms, which can be substituted with 1 to (2n+1) halogen atoms, where n is the number of carbon atoms of the alkyl group (for example $CF_3$), α, β-unsaturated linear or branched alkenyl or alkynyl groups with 2-10, preferably 2-6 and especially preferably 2-4 carbon atoms, which can be substituted with 1 to (2n−1) halogen atoms, preferably chlorine, where n is the number of carbon atoms of the alkyl group, for example $CH_2{=}CCl{-}$, cycloalkyl groups with 3-8 carbon atoms, which can be substituted with 1 to (2n−1) halogen atoms, preferably chlorine, where n is the number of carbon atoms of the cycloalkyl group; $C({=}Y^*)R^{5*}$, $C({=}Y^*)NR^{6*}R^{7*}$, $Y^*C({=}Y^*)R^{5*}$, $SOR^{5*}$, $SO_2R^{5*}$, $OSO_2R^{5*}$, $NR^{8*}SO_2R^{5*}$, $PR^{5*}_2$, $P({=}Y^*)R^{5*}_2$, $Y^*PR^{5*}_2$, $Y^*P({=}Y^*)R^5_2$, $NR^{8*}_2$, which can be quaternized with an additional $R^{8*}$, aryl, or heterocyclyl group, where Y* can be $NR^{8*}$, S or O, preferably O; $R^{5*}$ is an alkyl group with 1-20 carbon atoms, an alkylthio group with 1-20 carbon atoms, $OR^{15}$ ($R^{15}$ is hydrogen or an alkali metal), alkoxy with 1-20 carbon atoms, aryloxy or heterocyclyloxy; $R^{6*}$ and $R^{7*}$ independently are hydrogen or an alkyl group with one to 20 carbon atoms, or $R^{6*}$ and $R^{7*}$ together can form an alkylene group with 2-7, preferably 2-5 carbon atoms, where they form a 3-8 member, preferably 3-6 member ring, and $R^{8*}$ is linear or branched alkyl or aryl groups with 1-20 carbon atoms;

$R^{3*}$ and $R^{4*}$ independently are chosen from the group consisting of hydrogen, halogen (preferably fluorine or chlorine), alkyl groups with 1-6 carbon atoms and $COOR^{9*}$, where $R^{9*}$ is hydrogen, an alkali metal or an alkyl group with 1-40 carbon atoms, or $R^{1*}$ and $R^{3*}$ can together form a group of the formula $(CH_2)_n$, which can be substituted with 1-2n' halogen atoms or $C_1$-$C_4$ alkyl groups, or can form a group of the formula $C({=}O){-}Y^*{-}C({=}O)$, where n is from 2-6, preferably 3 or 4, and Y* is defined as before; and where at least 2 of the residues $R^{1*}$, $R^{2*}$, $R^{3*}$ and $R^{4*}$ are hydrogen or halogen.

These include, among others, hydroxyalkyl (meth)acrylates like 3-hydroxypropyl (meth)acrylate, 3,4-dihydroxybutyl (meth)acrylate, 2-hydroxyethyl (meth)acrylate, 2-hydroxypropyl (meth)acrylate, 2,5-dimethyl-1,6-hexanediol (meth) acrylate, 1,10-decanediol (meth)acrylate;

aminoalkyl (meth)acrylates and aminoalkyl (meth)acrylamides like N-(3-dimethylaminopropyl)methacrylamide, 3-diethylaminopentyl (meth)acrylate, 3-dibutylaminohexadecyl (meth)acrylate;

nitriles of (meth)acrylic acid and other nitrogen-containing (meth)acrylates like N-(methacryloyloxyethyl)diisobutylketimine, N-(methacryloyloxyethyl)dihexadecylketimine, (meth)acryloylamidoacetonitrile, 2-methacryloyloxyethylmethylcyanamide, cyanomethyl (meth) acrylate;

aryl (meth)acrylates like benzyl (meth)acrylate or phenyl (meth)acrylate, where the acryl residue in each case can be unsubstituted or substituted up to four times;

carbonyl-containing (meth)acrylates like 2-carboxyethyl (meth)acrylate, carboxymethyl (meth)acrylate, oxazolidinylethyl (meth)acrylate, N-methyacryloyloxy)formamide, acetonyl (meth)acrylate, N-methacryloylmorpholine, N-methacryloyl-2-pyrrolidinone, N-(2-methyacryloxyoxyethyl)-2-pyrrolidinone, N-(3-methacryloyloxypropyl)-2-pyrrolidinone, N-(2-methyacryloyloxypentadecyl(-2-pyrrolidinone, N-(3-methacryloyloxyheptadecyl-2-pyrrolidinone;

(meth)acrylates of ether alcohols like tetrahydrofurfuryl (meth)acrylate, vinyloxyethoxyethyl (meth)acrylate, methoxyethoxyethyl (meth)acrylate, 1-butoxypropyl (meth)acrylate, 1-methyl-(2-vinyloxy)ethyl (meth)acrylate, cyclohexyloxymethyl (meth)acrylate, methoxymethoxyethyl (meth)acrylate, benzyloxymethyl (meth)acrylate, furfuryl (meth)acrylate, 2-butoxyethyl (meth)acrylate, 2-ethoxyethoxymethyl (meth)acrylate, 2-ethoxyethyl (meth)acrylate, ethoxylated (meth)acrylates, allyloxymethyl (meth)acrylate, 1-ethoxybutyl (meth)acrylate, methoxymethyl (meth)acrylate, 1-ethoxyethyl (meth)acrylate, ethoxymethyl (meth)acrylate;

(meth)acrylates of halogenated alcohols like 2,3-dibromopropyl (meth)acrylate, 4-bromophenyl (meth)acrylate, 1,3-dichloro-2-propyl (meth)acrylate, 2-bromoethyl (meth)acrylate, 2-iodoethyl (meth)acrylate, chloromethyl (meth)acrylate;

oxiranyl (meth)acrylate like 2,3-epoxybutyl (meth)acrylate, 3,4-epoxybutyl (meth)acrylate, 10,11 epoxyundecyl (meth)acrylate, 2,3-epoxycyclohexyl (meth)acrylate, oxiranyl (meth)acrylates such as 10,11-epoxyhexadecyl (meth)acrylate, glycidyl (meth)acrylate;

phosphorus-, boron- and/or silicon-containing (meth)acrylates like 2-(dimethylphosphato)propyl (meth)acrylate, 2-(ethylphosphito)propyl (meth)acrylate, 2-dimethylphosphinomethyl (meth)acrylate, dimethylphosphonoethyl (meth)acrylate, diethylmethacryloyl phosphonate, dipropylmethacryloyl phosphate, 2-(dibutylphosphono)ethyl (meth)acrylate, 2,3-butylenemethacryloylethyl borate, methyldiethoxymethacryloylethoxysiliane, diethylphosphatoethyl (meth)acrylate;

sulfur-containing (meth)acrylates like ethylsulfinylethyl (meth)acrylate, 4-thiocyanatobutyl (meth)acrylate, ethylsulfonylethyl (meth)acrylate, thiocyanatomethyl (meth)acrylate, methylsulfinylmethyl (meth)acrylate, bis(methacryloyloxyethyl) sulfide;

heterocyclic (meth)acrylates like 2-(1-imidazolyl)ethyl (meth)acrylate, 2-(4morpholinyl)ethyl (meth)acrylate and 1-(2-methacryloyloxyethyl)-2-pyrrolidone;

vinyl halides such as, for example, vinyl chloride, vinyl fluoride, vinylidene chloride and vinylidene fluoride;

vinyl esters like vinyl acetate;

vinyl monomers containing aromatic groups like styrene, substituted styrenes with an alkyl substituent in the side chain, such as α-methylstyrene and α-ethylstyrene, substituted styrenes with an alkyl substituent on the ring such as vinyltoluene and p-methylstyrene, halogenated styrenes such as monochlorostyrenes, dichlorostyrenes, tribromostyrenes and tetrabromostyrenes;

heterocyclic vinyl compounds like 2-vinylpyridine, 3-vinylpyridine, 2-methyl-5-vinylpyridine, 3-ethyl-4-vinylpyridine, 2,3-dimethyl-5-vinylpyridine, vinylpyrimidine, vinylpiperidine, 9-vinylcarbazole, 3-vinylcarbazole, 4-vinylcarbazole, 1-vinylimidazole, 2-methyl-1-vinylimidazole, N-vinylpyrrolidone, 2-vinylpyrrolidone, N-vinylpyrrolidine, 3-vinylpyrrolidine, N-vinylcaprolactam, N-vinylbutyrolactam, vinyloxolane, vinylfuran, vinylthiophene, vinylthiolane, vinylthiazoles and hydrogenated vinylthiazoles, vinyloxazoles and hydrogenated vinyloxazoles;

vinyl and isoprenyl ethers;

maleic acid derivatives such as maleic anhydride, methylmaleic anhydride, maleinimide, methylmaleinimide;

fumaric acid and fumaric acid derivatives such as, for example, mono- and diesters of fumaric acid.

Monomers that have dispersing functionality can also be used as comonomers. These monomers are well known in the art and contain usually hetero atoms such as oxygen and/or nitrogen. For example the previously mentioned hydroxyalkyl (meth)acrylates, aminoalkyl (meth)acrylates and aminoalkyl (meth)acrylamides, (meth)acrylates of ether alcohols, heterocyclic (meth)acrylates and heterocyclic vinyl compounds are considered as dispersing comononers.

Especially preferred mixtures contain methyl methacrylate, lauryl methacrylate and/or stearyl methacrylate.

The components can be used individually or as mixtures.

The molecular weight of the alkyl(meth)acrylate polymers is not critical. Usually the alkyl(meth)acrylate polymers have a molecular weight in the range of 300 to 1,000,000 g/mol, preferably in the range of range of 10000 to 200,000 g/mol and especially preferably in the range of 25000 to 100,000 g/mol, without any limitation intended by this. These values refer to the weight average molecular weight of the polydisperse polymers.

Without intending any limitation by this, the alkyl(meth) acrylate polymers exhibit a polydispersity, given by the ratio of the weight average molecular weight to the number average molecular weight $M_w/M_n$, in the range of 1 to 15, preferably 1.1 to 10, especially preferably 1.2 to 5.

The monomer mixtures described above can be polymerized by any known method. Conventional radical initiators can be used to perform a classic radical polymerization. These initiators are well known in the art. Examples for these radical initiators are azo initiators like 2,2'-azodiisobutyronitrile (AIBN), 2,2'-azobis(2-methylbutyronitrile) and 1,1-azobiscyclohexane carbonitrile; peroxide compounds, e.g. methyl ethyl ketone peroxide, acetyl acetone peroxide, dilauryl peroxide, tert.-butyl per-2-ethyl hexanoate, ketone peroxide, methyl isobutyl ketone peroxide, cyclohexanone peroxide, dibenzoyl peroxide, tert.-butyl perbenzoate, tert.-butyl peroxy isopropyl carbonate, 2,5-bis(2-ethylhexanoyl-peroxy)-2,5-dimethyl hexane, tert.-butyl peroxy 2-ethyl hexanoate, tert.-butyl peroxy-3,5,5-trimethyl hexanoate, dicumene peroxide, 1,1-bis(tert.-butyl peroxy) cyclohexane, 1,1-bis(tert.-butyl peroxy) 3,3,5-trimethyl cyclohexane, cumene hydroperoxide and tert.-butyl hydroperoxide.

Low molecular weight poly(meth)acrylates can be obtained by using chain transfer agents. This technology is ubiquitously known and practiced in the polymer industry and is described in Odian, Principles of Polymerization, 1991. Examples of chain transfer agents are sulfur containing compounds such as thiols, e.g. n- and t-dodecanethiol, 2-mercaptoethanol, and mercapto carboxylic acid esters, e.g. methyl-3-mercaptopropionate. Preferred chain transfer agents contain up to 20, especially up to 15 and more preferably up to 12 carbon atoms. Furthermore, chain transfer agents may contain at least 1, especially at least 2 oxygen atoms.

Furthermore, the low molecular weight poly(meth)acrylates can be obtained by using transition metal complexes, such as low spin cobalt complexes. These technologies are well known and for example described in USSR patent 940, 487-A and by Heuts, et al., Macromolecules 1999, pp 2511-2519 and 3907-3912.

Furthermore, novel polymerization techniques such as ATRP (Atom Transfer Radical Polymerization) and or RAFT (Reversible Addition Fragmentation Chain Transfer) can be applied to obtain useful poly(meth)acrylates. These methods are well known. The ATRP reaction method is described, for example, by J-S. Wang, et al., J. Am. Chem. Soc., Vol. 117, pp. 5614-5615 (1995), and by Matyjaszewski, Macromolecules, Vol. 28, pp. 7901-7910 (1995). Moreover, the patent applications WO 96/30421, WO 97/47661, WO 97/18247, WO 98/40415 and WO 99/10387 disclose variations of the ATRP explained above to which reference is expressly made for purposes of the disclosure. The RAFT method is extensively presented in WO 98/01478, for example, to which reference is expressly made for purposes of the disclosure.

The polymerization can be carried out at normal pressure, reduced pressure or elevated pressure. The polymerization temperature is also not critical. However, in general it lies in the range of −20-200° C., preferably 0-130° C. and especially preferably 60-120° C., without any limitation intended by this.

The polymerization can be carried out with or without solvents. The term solvent is to be broadly understood here.

The functional fluid may comprise 0,5 to 50% by weight, especially 1 to 30% by weight, and preferably 5 to 20% by weight, based on the total weight of the functional fluid, of one or more polyalkylmethacrylate polymers.

The functional fluid of the present invention may comprise a base stock. These base stocks may comprise a mineral oil and/or a synthetic oil.

Mineral oils are substantially known and commercially available. They are in general obtained from petroleum or crude oil by distillation and/or refining and optionally additional purification and processing methods, especially the higher-boiling fractions of crude oil or petroleum fall under the concept of mineral oil. In general, the boiling point of the mineral oil is higher than 200° C., preferably higher than 300° C., at 5000 Pa. Preparation by low temperature distillation of shale oil, coking of hard coal, distillation of lignite under exclusion of air as well as hydrogenation of hard coal or lignite is likewise possible. To a small extent mineral oils are also produced from raw materials of plant origin (for example jojoba, rapeseed (canola), sunflower, soybean oil) or animal origin (for example tallow or neatsfoot oil). Accordingly, mineral oils exhibit different amounts of aromatic, cyclic, branched and linear hydrocarbons, in each case according to origin.

In general, one distinguishes paraffin-base, naphthenic and aromatic fractions in crude oil or mineral oil, where the term paraffin-base fraction stands for longer-chain or highly branched isoalkanes and naphthenic fraction stands for cycloalkanes. Moreover, mineral oils, in each case according to origin and processing, exhibit different fractions of n-alkanes, isoalkanes with a low degree of branching, so called monomethyl-branched paraffins, and compounds with heteroatoms, especially O, N and/or S, to which polar properties are attributed. However, attribution is difficult, since individual alkane molecules can have both long-chain branched and cycloalkane residues and aromatic components. For purposes of this invention, classification can be done in accordance with DIN 51 378. Polar components can also be determined in accordance with ASTM D 2007.

The fraction of n-alkanes in the preferred mineral oils is less than 3 wt %, and the fraction of O, N and/or S-containing compounds is less than 6 wt %. The fraction of aromatic compounds and monomethyl-branched paraffins is in general in each case in the range of 0-40 wt %. In accordance with one interesting aspect, mineral oil comprises mainly naphthenic and paraffin-base alkanes, which in general have more than 13, preferably more than 18 and especially preferably more than 20 carbon atoms. The fraction of these compounds is in general at least 60 wt %, preferably at least 80 wt %, without any limitation intended by this. A preferred mineral oil contains 0.5-30 wt % aromatic components, 15-40 wt % naphthenic components, 35-80 wt % paraffin-base components, up to 3 wt % n-alkanes and 0.05-5 wt % polar components, in each case with respect to the total weight of the mineral oil.

An analysis of especially preferred mineral oils, which was done with traditional methods such as urea dewaxing and liquid chromatography on silica gel, shows, for example, the following components, where the percentages refer to the total weight of the relevant mineral oil:

n-alkanes with about 18-31 C atoms: 0.7-1.0%,
low-branched alkanes with 18-31 C atoms: 1.0-8.0%,
aromatic compounds with 14-32 C atoms: 0.4-10.7%,
iso- and cycloalkanes with 20-32 C atoms: 60.7-82.4%,
polar compounds: 0.1-0.8%,
loss: 6.9-19.4%.

Valuable advice regarding the analysis of mineral oil as well as a list of mineral oils that have other compositions can be found, for example, in Ullmann's Encyclopedia of Industrial Chemistry, $5^{th}$ Edition on CD-ROM, 1997, under the entry "lubricants and related products."

Preferably, the functional fluid is based on mineral oil from Group I, II, or III.

Synthetic oils are, among other substances, organic esters like carboxylic esters and phosphate esters; organic ethers like silicone oils and polyalkylene glycol; and synthetic hydrocarbons, especially polyolefins. They are for the most part somewhat more expensive than the mineral oils, but they have advantages with regard to performance. For an explanation one should refer to the 5 API classes of base oil types (API: American Petroleum Institute).

Phosphorus ester fluids such as alkyl aryl phosphate ester; trialkyl phosphates such as tributyl phosphate or tri-2-ethylhexyl phosphate; triaryl phosphates such as mixed isopropylphenyl phosphates, mixed t-butylphenyl phosphates, trixylenyl phosphate, or tricresylphosphate. Additional classes of organophosphorus compounds are phosphonates and phosphinates, which may contain alkyl and/or aryl substituents. Dialkyl phosphonates such as di-2-elhylhexylphosphonate; alkyl phosphinates such as di-2-elhylhexylphosphinate are possible. As the alkyl group herein, linear or branched chain alkyls consisting of 1 to 10 carbon atoms are preferred. As the aryl group herein, aryls consisting of 6 to 10 carbon atoms that maybe substituted by alkyls are preferred. Usually the functional fluids contain 0 to 60% by weight, preferably 5 to 50% by weight organophosphorus compounds.

As the carboxylic acid esters reaction products of alcohols such as polyhydric alcohol, monohydric alcohol and the like, and fatty acids such as mono carboxylic acid, poly carboxylic acid and the like can be used. Such carboxylic acid esters can of course be a partial ester.

Carboxylic acid esters may have one carboxylic ester group having the formula R—COO—R, wherein R is independently a group comprising 1 to 40 carbon atoms. Preferred ester compounds comprise at least two ester groups. These compounds may be based on poly carboxylic acids having at least two acidic groups and/or polyols having at least two hydroxyl groups.

The poly carboxylic acid residue usually has 2 to 40, preferably 4 to 24, especially 4 to 12 carbon atoms. Useful polycarboxylic acids esters are, e.g., esters of adipic, azelaic, sebacic, phthalate and/or dodecanoic acids. The alcohol component of the polycarboxylic acid compound preferably comprises 1 to 20, especially 2 to 10 carbon atoms.

Examples of useful alcohols are methanol, ethanol, propanol, butanol, pentanol, hexanol, heptanol and octanol. Furthermore, oxoalcohols can be used such as diethylene glycol, triethylene glycol, tetraethylene glycol up to decamethylene glycol.

Especially preferred compounds are esters of polycarboxylic acids with alcohols comprising one hydroxyl group. Examples of these compounds are described in Ullmans Encyclopädie der Technischen Chemie, third edition, vol. 15, page 287-292, Urban & Schwarzenber (1964)).

According to another aspect of the present invention, the functional fluid is based on a synthetic basestock comprising Poly-alpha olefin (PAO), carboxylic esters (diester, or polyol ester), phosphate ester (trialkyl, triaryl, or alkyl aryl phosphates), and/or polyalkylene glycol (PAG).

The functional fluid of the present invention may comprise further additives well known in the art such as viscosity index improvers, antioxidants, anti-wear agents, corrosion inhibitors, detergents, dispersants, EP additives, defoamers, friction reducing agents, pour point depressants, dyes, odorants and/or demulsifiers. These additives are used in conventional amounts. Usually the functional fluids contain 0 to 10% by weight additives.

According to the consumer needs, the viscosity of the functional fluid of the present invention can be adapted with in wide range. ISO VG 15, VG 22, VG 32, VG 46, VG 68, VG 100, VG 150, VG 1500 and VG 3200 fluid grades can be achieved, e.g.

| ISO 3448 or ASTM 2422 Viscosity Grades | Typical Viscosity, cSt @ 40° C. | Minimum Viscosity, cSt @ 40° C. | Maximum Viscosity, cSt @ 40° C. |
|---|---|---|---|
| ISO VG 15 | 15.0 | 13.5 | 16.5 |
| ISO VG 22 | 22.0 | 19.8 | 24.2 |
| ISO VG 32 | 32.0 | 28.8 | 35.2 |
| ISO VG 46 | 46.0 | 41.4 | 50.6 |
| ISO VG 68 | 68.0 | 61.2 | 74.8 |
| ISO VG 100 | 100.0 | 90.0 | 110.0 |

-continued

| ISO 3448 or ASTM 2422 Viscosity Grades | Typical Viscosity, cSt @ 40° C. | Minimum Viscosity, cSt @ 40° C. | Maximum Viscosity, cSt @ 40° C. |
|---|---|---|---|
| ISO VG 150 | 150.0 | 135.0 | 165.0 |
| ISO VG 1500 | 1500.0 | 1350.0 | 1650.0 |
| ISO VG 3200 | 3200.0 | 2880.0 | 3520.0 |

The viscosity grades as mentioned above can be considered as precribed ISO viscosity grade. Preferably, the ISO viscosity grade is in the range of 15 to 3200, more preferably 22 to 150.

According to a further aspect of the invention the preferred ISO viscosity grade is in the range of 150 to 3200, more preferably 1500 to 3200.

In order to achieve a prescribed ISO viscosity grade, preferably a base stock having a low viscosity grade is mixed with the polyalkylmethacrylate polymer.

Preferably the kinematic viscosity 40° C. according to ASTM D 445 of is the range of 15 $mm^2/s$ to 150 $mm^2/s$, preferably 28 $mm^2/s$ to 110 $mm^2/s$. The functional fluid of the present invention has a high viscosity index. Preferably the viscosity index according to ASTM D 2270 is at least 120, more preferably 150, especially at least 180 and more preferably at least 200.

The air release performance of functional fluids and lubricants is typically measured by the test methods ASTM D3427 or DIN 51 381. These methods are nearly identical, and are the most widely referenced test methods used in the major regional hydraulic fluid quality standards, such as ASTM D 6158 (North America), DIN 51524 (Europe), and JCMAS HK (Japan). These methods are also specified when measuring the air release properties of turbine lubricants and gear oils.

A typical apparatus can be found in FIG. 1. A more detailed description of the method is mentioned in the examples.

Figure 2:
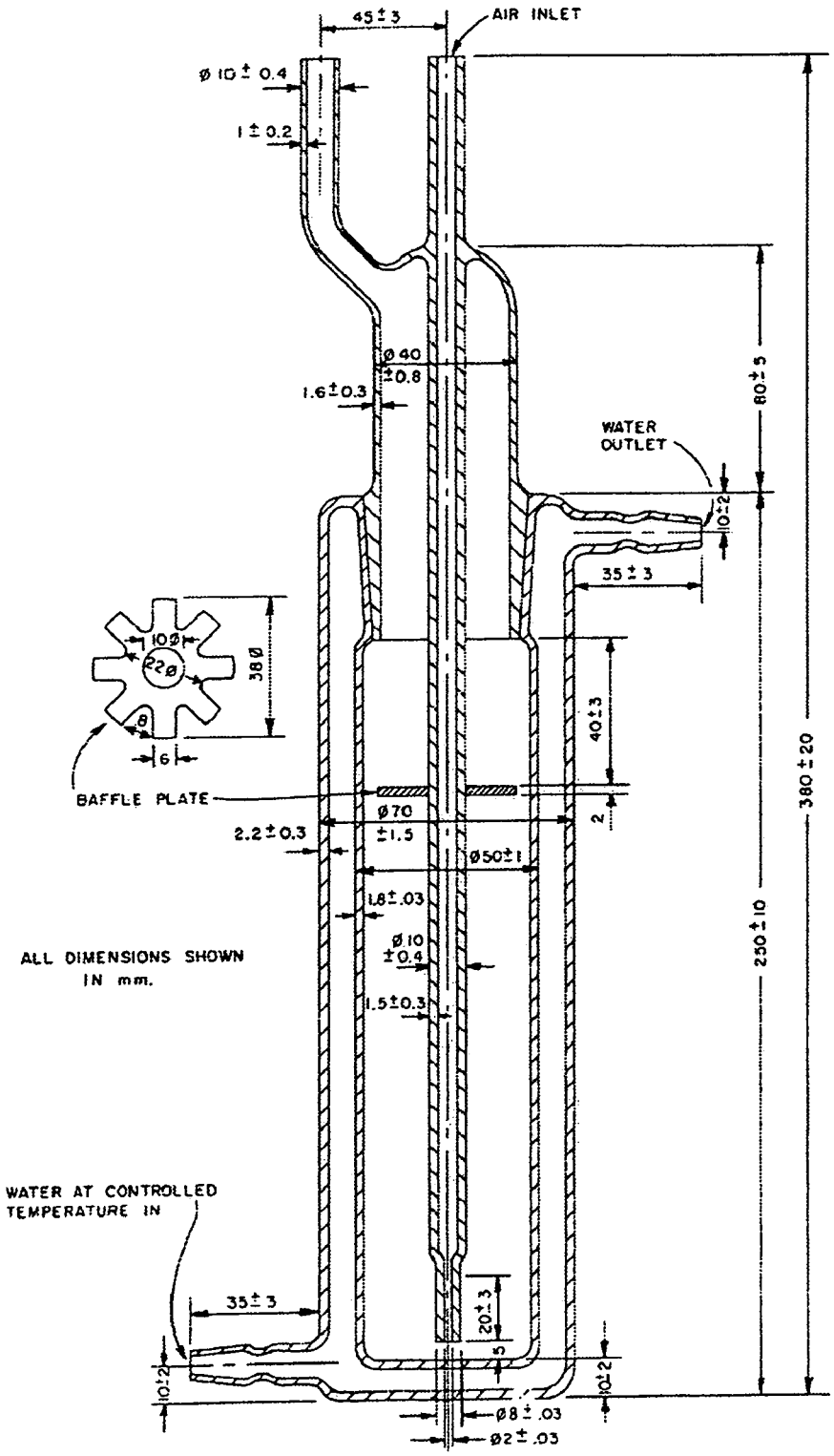

A further specific glass test vessel is required as shown in FIG. 2, consisting of a jacketed sample tube fitted with an air inlet capillary, baffle plate, and an air outlet tube.

Preferably the air release of the functional fluid is lower than 7 minutes, preferably lower than 6 minutes and preferably lower than 5 minutes measured according to the method mentioned in the examples of the present patent application.

The functional fluid of the present invention has good low temperature performance. The low temperature performance can be evaluated by the Brookfield viscosimeter according to ASTM D 2983.

The functional fluid of the present invention can be used for high pressure applications. Preferred embodiments can be used at pressures between 0 to 700 bar, and specifically between 70 and 400 bar.

Furthermore, preferred functional fluids of the present invention have a low pour point, which can be determined, for example, in accordance with ASTM D 97. Preferred fluids have a pour point of −30° C. or less, especially −40° C. or less and more preferably −45° C. or less.

The functional fluid of the present invention can be used over a wide temperature range. For example the fluid can be used in a temperature operating window of −40° C. to 120° C., and meet the equipment manufactures requirements for minimum and maximum viscosity. A summary of major equipment manufacturers viscosity guidelines can be found in National Fluid Power Association recommended practice T2.13.13-2002.

The functional fluids of the present invention are useful e.g. in industrial, automotive, mining, power generation, marine and military hydraulic fluid applications. Mobile equipment applications include construction, forestry, delivery vehicles and municipal fleets (trash collection, snow plows, etc.). Marine applications include ship deck cranes.

The functional fluids of the present invention are useful in power generation hydraulic equipment such as electrohydraulic turbine control systems.

Furthermore, the functional fluids of the present invention are useful as transformer liquids or quench oils.

The invention is illustrated in more detail below by examples and comparison examples, without intending to limit the invention to these examples.

EXAMPLES 1 TO 10 AND COMPARATIVE EXAMPLES 1 TO 3

The fluid compositions of examples 1 to 10 and comparative examples A to C have been prepared by mixing Group 1 mineral oil base stocks (combinations of 70N Mineral oil=70 SUS solvent refined Group 1 paraffinic mineral oil, 100N Mineral oil=100 SUS solvent refined Group 1 paraffinic mineral oil; 150N Mineral oil=150 SUS solvent refined Group 1 paraffinic mineral oil; 600BS Mineral oil=600 SUS bright stock Group 1 mineral oil). The fluids were mixed in order to achieve the viscosity data as mentioned in Table 3. The PAMA polymer used was VISCOPLEX 8-219 available from RohMax Oil Additives. Slightly different ratios of base oils were required in order to achieve identical viscosities at 40 and 50° C., with and without the PAMA polymer. The air release time of these fluids has been measured according to ASTM D 3427.

Air Release Testing Details:

180 ml of the fluid sample is transferred into a clean glass tube, and the oil is allowed to equilibrate to the desired test temperature. The test procedure requires that oils with a viscosity at 40° C. between 9 and 90 cSt shall be evaluated at 50° C., which is a typical oil sump temperature for many types of hydraulic equipment. This viscosity range describes the most widely used ISO viscosity grades 15, 22, 32, 46, and 68. When the fluid has stabilized at 50° C., the original density is measured using a density balance. The density balance is removed and the air inlet capillary tube is inserted into the oil. The required test equipment layout can be found in FIG. 1.

The test is initiated when the flow of compressed air is turned on at a gage pressure of 20 kPa. An air-in-oil dispersion is created by the stream of compressed air entering the oil through the capillary tube. Vigorous bubbling can be observed during the aeration period. After 7.0 minutes, the air flow is turned off, the capillary tube is removed from the fluid, and the timer is started. The sinker of the density balance is immersed in the fluid and the density is measured.

The time required for the fluid to return to within 0.2% of its original density is measured and recorded as the air release time.

The results are shown in Table 3

TABLE 3 air release time by ASTM D 3427

| Sample ID | ISO Viscosity Grade | PAMA polymer content, Weight % | Viscosity @ 40°, cSt | Viscosity @ 50° Test Temperature, cSt | Air Release Time, Minutes | % Reduction over 0 wt. % PAMA |
|---|---|---|---|---|---|---|
| Comp. Ex. A | ISO VG 46 | 0 | 45.93 | 29.85 | 6.7 | — |
| Ex. 1 | ISO VG 46 | 7 | 43.45 | 29.75 | 2.5 | 62.7 |
| Ex. 2 | ISO VG 46 | 8 | 46.35 | 31.68 | 3.0 | 55.2 |
| Ex. 3 | ISO VG 46 | 15 | 41.72 | 29.87 | 2.6 | 61.2 |
| Ex. 4 | ISO VG 46 | 16 | 46.39 | 33.06 | 2.8 | 58.2 |
| Comp. Ex. B | ISO VG 68 | 0 | 67.98 | 42.8 | 7.5 | — |
| Ex. 5 | ISO VG 68 | 8 | 64.26 | 43.08 | 3.9 | 48.0 |
| Ex. 6 | ISO VG 68 | 9 | 68.47 | 45.77 | 3.9 | 48.0 |
| Ex. 7 | ISO VG 68 | 19 | 60.34 | 42.62 | 3.9 | 41.3 |
| Ex. 8 | ISO VG 68 | 20 | 69.1 | 48.47 | 3.9 | 48.0 |
| Comp. Ex. C | ISO VG 100 | 0 | 99.9 | 61.04 | 15 | — |
| Ex. 9 | ISO VG 100 | 11 | 93.23 | 61.53 | 5.2 | 65.3 |
| Ex. 10 | ISO VG 100 | 12 | 100.3 | 66.02 | 5.7 | 62.0 |

This development indicates that PAMA containing fluids will exhibit faster air release times compared to standard fluids of identical ISO grade and viscosity characteristics. It also shows that higher viscosity grade fluids can now be used to achieve improved lubrication or pump efficiency performance without risking damage which might be expected from standard non-PAMA containing fluids. Table 3 also shows that more viscous fluid grades containing PAMA have a better air release than less viscous standard fluids. Accordingly, the comparative example 1 has a slower air release than examples 5 to 8. Similarly, the comparative example 2 has a slower air release than examples 9 and 10.

It is important to observe that these ISO 68 and ISO 100 fluids containing PAMA additive now meet all of the global air release specification requirements expected for an ISO VG 46 fluid. This performance benefit offers the operator and system designer a significant advantage.

The invention claimed is:

1. A method of improving the air release of a functional fluid, comprising:

mixing at least one base oil with a polyalkymethacrylate polymer, to obtain a functional fluid;

wherein an ISO viscosity grade of said functional fluid is maintained compared to a functional fluid which does not comprise said polyalkylmethacrylate polymer;

wherein said functional fluid comprises 1-30% by weight of said polyalkylmethacrylate polymer.

2. The method according to claim 1, wherein said ISO viscosity grade is in the range of 15 to 3200.

3. The method according to claim 1, wherein said polyalkylmethacrylate polymer comprises at least 40% by weight methacrylate repeating units.

4. The method according to claim 1, wherein said functional fluid has a viscosity index according to ASTM D 2270 of at least 120.

5. The method according to claim 1, wherein said polyalkylmethacrylate polymer has a molecular weight in the range of 10000-200000 g/mol.

6. The method according to claim 1, wherein said polyalkylmethacrylate polymer comprises $C_9$-$C_{34}$ methacrylate repeating units and $C_1$-$C_8$ methacrylate repeating units.

7. The method according to claim 1, wherein said polyalkylmethacrylate polymer comprises repeating units derived from dispersant monomers.

8. The method according to claim 1, wherein said polyalkylmethacrylate polymer comprises repeating units derived from styrene.

9. The method according to claim 1, wherein said polyalkylmethacrylate polymer comprises repeating units derived from ethoxylated and/or hydroxylated methacrylate monomers.

10. The method according to claim 1, wherein said functional fluid comprises antioxidants, corrosion inhibitors, defoamers or mixtures thereof.

11. The method according to claim 1, wherein said functional fluid comprises a mineral oil.

12. The method according to claim 1, wherein said functional fluid comprises at least one synthetic oil.

13. The method according to claim 12, wherein said synthetic oil comprises a poly-alpha olefin, a carboxylic ester, a carboxylic diester, a polyol ester, a phosphate ester, a trialkyl phosphate ester, triaryl phosphate ester, alkyl aryl phosphate ester, a polyalkylene glycol or mixtures thereof.

14. The method according to claim 1, wherein said polyalkylmethacrylate polymer is obtained by polymerizing a mixture of olefinically unsaturated monomers, and mixture comprising:

a) 0-100 wt %, based on a total weight of the ethylenically unsaturated monomers, of one or more ethylenically unsaturated ester compounds of formula (I)

(I)

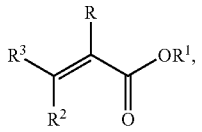

wherein

R is hydrogen or methyl, $R^1$ means a linear or branched alkyl residue with 1-8 carbon atoms, $R^2$ and $R^3$ independently represent hydrogen or a group of the formula —COOR', wherein R' means hydrogen or a alkyl group with a 1-8 carbon atoms b) 0-100 wt %, based on the total weight of the ethylenically unsaturated monomers, of one or more ethylenically unsaturated ester compounds of formula (II)

(II)

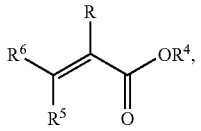

wherein

R is hydrogen or methyl, $R^4$ means a linear or branched alkyl residue with 9-16 carbon atoms, $R^5$ and $R^6$ independently are hydrogen or a group of the formula —COOR", wherein R" means hydrogen or an alkyl group with 9-16 carbon atoms, c) 0-80 wt %, based on the total weight of the ethylenically unsaturated monomers, of one or more ethylenically unsaturated ester compounds of formula (III)

(III)

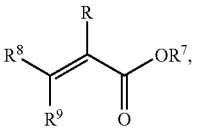

wherein

R is hydrogen or methyl, $R^7$ means a linear ox branched alkyl residue with 17-40 carbon atoms, $R^8$ and $R^9$ independently are hydrogen or a group of the formula —COOR'", wherein R'" means hydrogen or an alkyl group with 17-40 carbon atoms, d) 0-50 wt %, based on the total weight of the ethylenically unsaturated monomers, of comonomers, wherein at least 50 wt %, based on the total weight of the ethylenically unsaturated monomers, are methacrylates.

15. The method according to claim 14, wherein said mixture of olefinically unsaturated monomers comprises 50 to 95% by weight of the component b).

16. The method according to claim 14, wherein said mixture of olefinically unsaturated monomers comprises 1 to 30% by weight of the component a).

17. The method according to claim 1, wherein said functional fluid is a hydraulic fluid.

18. The method according to claim 1, wherein said polyalkylmethacrylate polymer has a molecular weight in the range of 25000 g/mol-100000 g/mol.

19. The method according to claim 1, wherein said functional fluid comprises a mineral oil from API Group I, II, or III.

20. The method according to claim 1, wherein said functional fluid comprises at least one synthetic oil from API Group IV and V.

21. A method of reducing noise, comprising:

mixing at least one base oil with a polyalkylmethacrylate polymer, to obtain a functional fluid;

wherein an ISO viscosity grade of said functional fluid is maintained compared to a functional fluid which does not comprise said polyalkylmethacrylate polymer;

contacting a hydraulic system with said functional fluid to improve the air release of said functional fluid and reduce the noise in said hydraulic system;

wherein said functional fluid comprises 1-30% by weight of said polyalkylmethacrylate polymer.

22. The method according to claim 21, wherein a source of the noise is cavitation.

23. The method according to claim 21, wherein said cavitation occurs when entrained air in said hydraulic fluid is compressed.

24. The method according to claim 21, wherein said functional fluid comprising said polymethacrylate polymer entrains less air and exhibits a faster air release time than a hydraulic fluid having no polymethacrylate polymer.

25. The method according to claim 21, wherein said functional fluid comprising said polymethacrylate polymer reduces noise associated with cavitation.

26. A method of reducing entrained air in a functional fluid, comprising:

mixing at least one base oil with a polyalkylmethacrylate polymer, to obtain a functional fluid;

so that said functional fluid comprises 1-30% by weight of said polyalkylmethacrylate polymer to improve the air release of said functional fluid;

wherein an ISO viscosity grade of said functional fluid is maintained compared to a functional fluid which does not comprise said polyalkylmethacrylate polymer.

27. A method of improving the air release of a functional fluid, comprising:

mixing at least one base oil with a polyalkylmethacrylate polymer, to obtain a functional fluid;

wherein an ISO viscosity grade of said functional fluid is maintained compared to a functional fluid which does not comprise said polyalkylmethacrylate polymer, wherein said polyalkylmethacrylate polymer has a molecular weight in the range of 10000-200000 g/mol.

28. A method of reducing noise, comprising:

mixing at least one base oil with a polyalkylmethacrylate polymer, to obtain a functional fluid;

contacting a hydraulic system with said functional fluid to improve the air release of said functional fluid and reduce the noise in said hydraulic system;

wherein an ISO viscosity grade of said functional fluid is maintained compared to a functional fluid which does not comprise said polyalkylmethacrylate polymer, wherein said polyalkylmethacrylate polymer has a molecular weight in the range of 10000-200000 g/mol.

29. A method of reducing entrained air in a functional fluid, comprising:

mixing at least one base oil with a polyalkylmethacrylate polymer, to obtain a functional fluid and to improve the air release of said functional fluid;

wherein an ISO viscosity grade of said functional fluid is maintained compared to a functional fluid which does not comprise said polyalkylmethacrylate polymer, wherein said polyalkylmethacrylate polymer has a molecular weight in the range of 10000-200000 g/mol.

30. A method of improving the air release of a functional fluid, comprising:

mixing at least one base oil with a polyalkylmethacrylate polymer, to obtain a functional fluid;

wherein an ISO viscosity grade of said functional fluid is maintained compared to a functional fluid which does not comprise said polyalkylmethacrylate polymer;

wherein said polyalkylmethacrylate polymer comprises $C_9$-$C_{24}$ methacrylate repeating units and $C_1$-$C_8$ methacrylate repeating units.

31. A method of reducing noise, comprising:

mixing at least one base oil with a polyalkylmethacrylate polymer, to obtain a functional fluid;

contacting a hydraulic system with said functional fluid to improve the air release of said functional fluid and reduce the noise in said hydraulic system;

wherein an ISO viscosity grade of said functional fluid is maintained compared to a functional fluid which does not comprise said polyalkylmethacrylate polymer;

wherein said polyalkylmethacrylate polymer comprises $C_9$-$C_{24}$ methacrylate repeating units and $C_1$-$C_8$ methacrylate repeating units.

32. A method of reducing entrained air in a functional fluid, comprising:

mixing at least one base oil with a polyalkylmethacrylate polymer, to obtain a functional fluid;

contacting said functional fluid with a polyalkylmethacrylate polymer to improve the air release of said functional fluid;

wherein said polyalkylmethacrylate polymer comprises $C_9$-$C_{24}$ methacrylate repeating units and $C_1$-$C_8$ methacrylate repeating units;

wherein an ISO viscosity grade of said functional fluid is maintained compared to a functional fluid which does not comprise said polyalkylmethacrylate polymer.

33. The method according to claim 1, wherein said functional fluid is a lubricant.

* * * * *